US009905057B2

(12) United States Patent
Stacy

(10) Patent No.: US 9,905,057 B2
(45) Date of Patent: Feb. 27, 2018

(54) DRIVING BEHAVIOR MONITORING SYSTEM

(71) Applicant: WUNELLI LIMITED, Portsmouth, Hampshire (GB)

(72) Inventor: Paul Rowan Stacy, Petersfield (GB)

(73) Assignee: WUNELLI LIMITED, Portsmouth, Hampshire (GB)

( * ) Notice: Subject to any disclaimer, the term of this patent is extended or adjusted under 35 U.S.C. 154(b) by 170 days.

(21) Appl. No.: 14/417,282

(22) PCT Filed: Jul. 26, 2013

(86) PCT No.: PCT/GB2013/052021
§ 371 (c)(1),
(2) Date: Jan. 26, 2015

(87) PCT Pub. No.: WO2014/016620
PCT Pub. Date: Jan. 30, 2014

(65) Prior Publication Data

US 2015/0213656 A1 Jul. 30, 2015

(30) Foreign Application Priority Data

Jul. 26, 2012 (GB) ..... 1213291.6

(51) Int. Cl.
*G07C 5/00* (2006.01)
*G07C 5/08* (2006.01)

(52) U.S. Cl.
CPC ..... *G07C 5/008* (2013.01); *G07C 5/08* (2013.01)

(58) Field of Classification Search
USPC ..... 701/31.5
See application file for complete search history.

(56) References Cited

U.S. PATENT DOCUMENTS 5,623,244 A * 4/1997 Cooper ..... B61L 23/041 246/166
5,786,750 A * 7/1998 Cooper ..... B61L 23/044 246/121

(Continued)

FOREIGN PATENT DOCUMENTS

EP 1811481 A1 7/2007
GB 2470147 A 11/2010

(Continued)

OTHER PUBLICATIONS

Charalampos Doukas and Ilias Maglogiannis, Advanced Computation Intelligence Paradigms in HealthCare, Chapter 9, Intelligent Pervasive Healthcare Systems, vol. 107 of the series Studies in Computational Intelligence pp. 95-115 (DOI 10.1007/978-3-540-77662-8_5).*

(Continued)

*Primary Examiner* — Jean Paul Cass
(74) *Attorney, Agent, or Firm* — Troutman Sanders LLP; Mark Lehi Jones

(57) ABSTRACT

A driving behavior monitoring system (11) comprising an on-board diagnostics module (3) adapted to be mounted in a vehicle, the on-board diagnostics module comprising a vehicle usage monitor operative to monitor usage of the vehicle and to generate vehicle usage data based on at least one usage characteristic of the vehicle, the system further comprising a controller (5) and a driving behavior scoring server (9) arranged to be in real-time communication with the controller via a telecommunications network, the on-board diagnostics module further comprising a transceiver operative to transmit the vehicle usage data to the server via the controller, the server comprising a database (12) on which vehicle usage data is stored, the server further comprising a data processor controlled by an algorithm such that the server is operative to generate an alert signal by pro- (Continued)

Figure 1:
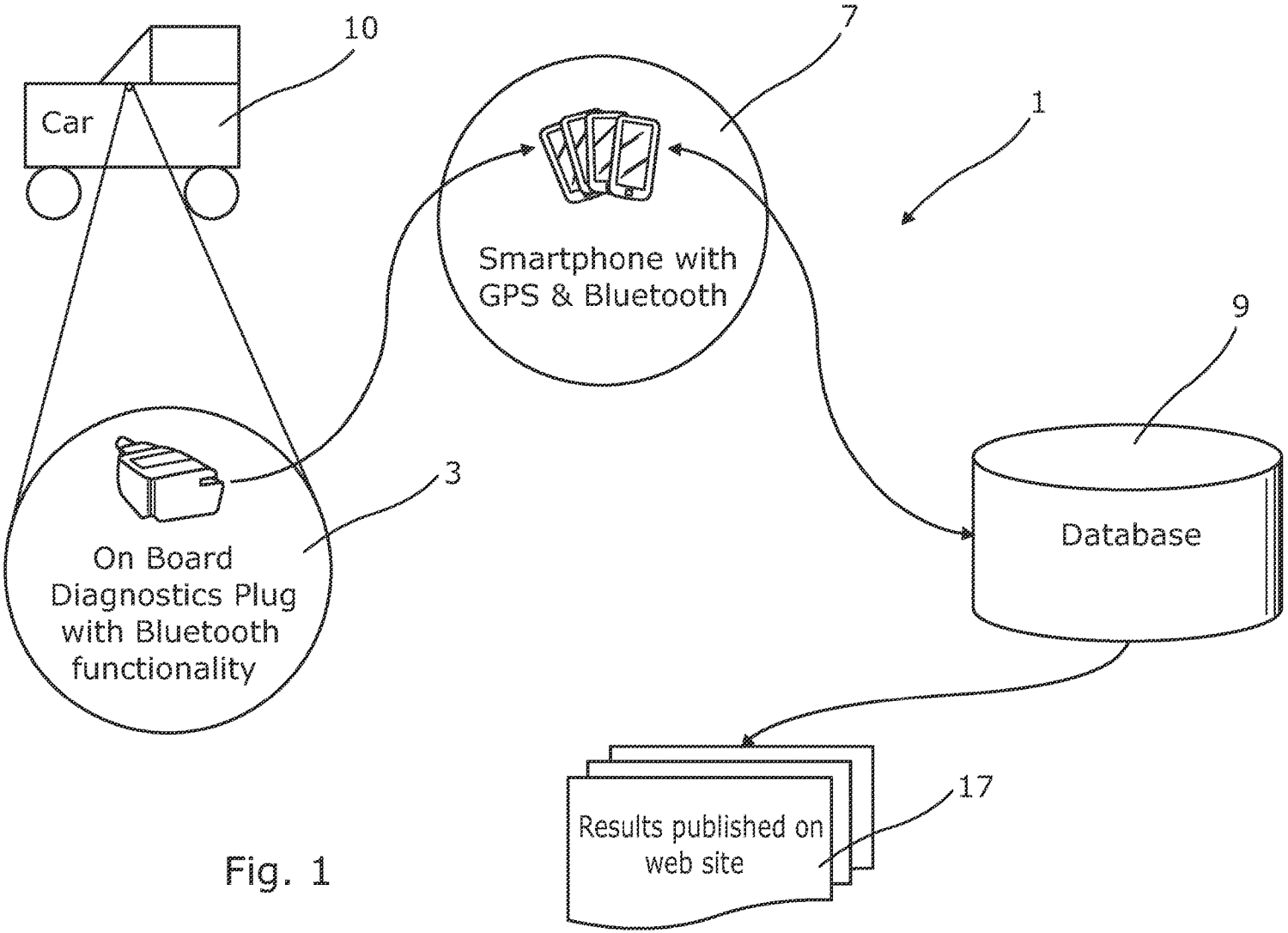

cessing the vehicle usage data generated by the on-board diagnostics module, the alert signal being indicative of a driving behavior score, and wherein the server is operative to transmit the alert signal from the server to the controller for review by the driver.

19 Claims, 2 Drawing Sheets

(56) References Cited

U.S. PATENT DOCUMENTS 5,926,142 A * 7/1999 Rathgeb ..... H01Q 1/3283 343/711
8,013,759 B1 * 9/2011 Aid ..... B60D 1/58 303/123
9,196,098 B2 * 11/2015 Phelan ..... G06Q 40/00
2007/0001831 A1 1/2007 Raz et al.
2007/0027583 A1 2/2007 Tamir et al.
2007/0275664 A1 * 11/2007 Uhl ..... H04B 7/0602 455/67.11
2008/0294690 A1 11/2008 McClellan
2009/0243517 A1 * 10/2009 Verfuerth ..... H05B 37/0272 315/315
2010/0036564 A1 * 2/2010 Blaise ..... B60W 10/06 701/42
2010/0207787 A1 8/2010 Catten
2010/0245038 A1 * 9/2010 Ghabra ..... G07C 9/00309 340/5.61
2011/0012720 A1 1/2011 Hirschfeld
2011/0077028 A1 3/2011 Wilkes, III
2011/0085287 A1 * 4/2011 Ebrom ..... G08C 17/02 361/679.01
2011/0112717 A1 * 5/2011 Resner ..... G07C 5/008 701/31.4
2011/0251752 A1 10/2011 DeLarocheliere et al.
2012/0089423 A1 4/2012 Tamir
2013/0176176 A1 * 7/2013 Vos ..... H01Q 1/38 343/700 MS
2013/0302758 A1 * 11/2013 Wright ..... G07C 5/008 434/65
2015/0213656 A1 * 7/2015 Stacy ..... G07C 5/008 701/31.5
2017/0160398 A1 * 6/2017 Venkatraman ..... G01S 19/34

FOREIGN PATENT DOCUMENTS

WO 2008107514 A1 9/2008
WO WO 2008107514 A1 * 9/2008 ..... G07C 5/008

OTHER PUBLICATIONS

International Search Report for related PCT Application No. PCT/GB2013/052021 dated Jan. 3, 2014.
Search Report under Section 17 for related GB Application No. 1213291.6 dated Dec. 19, 2012.

* cited by examiner

DRIVING BEHAVIOR MONITORING SYSTEM

CROSS-REFERENCE TO RELATED APPLICATIONS

This application is a U.S. National Stage of International Application No. PCT/GB2013/052021, filed 26 Jul. 2013, which claims the benefit of GB Application No. 1213291.6, filed 26 Jul. 2012, each herein fully incorporated by reference.

The present invention relates to a driving behaviour monitoring system.

It can be desirable to monitor how a vehicle is used in order to be able to use the vehicle usage data for a supplementary purpose. One use of such vehicle usage data is to be able to calculate, or adjust, a vehicle insurance premium in dependence upon how the vehicle is being used. Another use of such vehicle usage data would be to provide feedback to the driver on how they are driving, for example, how safely they are driving.

According to a first aspect of the invention there is provided a driving behaviour monitoring system comprising an on-board diagnostics module adapted to be mounted in a vehicle, the on-board diagnostics module comprising a vehicle usage monitor operative to monitor usage of the vehicle and to generate vehicle usage data based on at least one usage characteristic of the vehicle, the system further comprising a controller and a driving behaviour scoring server arranged to be in real-time communication with the controller via a telecommunications network, the on-board diagnostics module further comprising a transceiver operative to transmit the vehicle usage data to the server via the controller, the server comprising a database on which vehicle usage data is stored, the server further comprising a data processor controlled by an algorithm such that the server is operative to generate an alert signal by processing the vehicle usage data generated by the on-board diagnostics module and the road usage data stored on the database, the alert signal being indicative of a driving behaviour score.

Preferably the server is operative to transmit the alert signal from the server to the controller for review by the driver. The server and controller may be arranged such that the alert signal is transmitted to the controller such that the driver can review the driving score in real-time.

In one example, the on-board diagnostics module comprises a wireless transceiver operative to transmit and/or receive data from the controller wirelessly, the controller being provided on a separate mobile telecommunications device, such as a Smartphone for example. The wireless transceiver may comprise a Bluetooth® unit.

In another example, the on-board diagnostics module and controller are integral, the transceiver of the on-board diagnostics module comprising a mobile telecommunications transceiver operative to enable communication between the controller and the server via a mobile telecommunications network.

Preferably the on-board diagnostics module comprises a micro processor, a PCB, a flash memory, and a tri-axial accelerometer.

The on-board diagnostics module may be powered by its own internal battery, or comprise a suitable electrical connection to receive power from the vehicle.

The on-board diagnostics module may comprise an interface operative to connect with, and receive data from, the vehicle's European On Board Diagnostics (EOBD) port.

Preferably the on-board diagnostics module is operative to process a time signal and to obtain vehicle usage data at periodic time intervals, the on-board diagnostics module being operative to use the time signal to time stamp the vehicle usage data, and to send time stamped data packets of vehicle usage data to the controller.

The on-board diagnostics module may comprise a clock operative to generate its own time signal, or may receive a time signal generated from a clock on the controller or the server.

Preferably the on-board diagnostics module is operative to obtain vehicle usage data selected from one, some or all of the following vehicle usage characteristics:

a) Vehicle ignition-on and ignition-off events; and/or
b) Bluetooth device connection and disconnection events to/from EOBD port; and/or
c) Bluetooth power on and off events; and/or
d) Accelerometer data in three axes x, y and z; or and/or
e) Other data available from the appropriate vehicle management system.

The controller may comprise software or hardware on the mobile telecommunications device or the onboard diagnostics module, as appropriate. The controller may comprise a software application downloaded onto the mobile telecommunications device or the onboard diagnostics module.

The controller may also receive positional information from a GPS unit, the controller being operative to combine the positional information with the vehicle usage information from the on-board diagnostics module to form an aggregated vehicle usage data which is transmitted to the server.

The GPS unit may comprise a GPS unit on the mobile telecommunications device, or may comprise a GPS unit provided on the onboard diagnostics module.

Preferably the database on the server comprises data indicative of the road speed limit, the algorithm processing the vehicle usage data and the road speed limit data to generate the driving behaviour score.

The system may be capable of transmitting vehicle fault identifiers (to assist recovery services in the case of a breakdown) from the onboard diagnostics module.

According to a second aspect of the invention there is provided an on-board vehicle usage diagnostics module for use with a driving behaviour monitoring system, the on-board diagnostics module adapted to be mounted in a vehicle, and a vehicle usage monitor operative to monitor usage of the vehicle and to generate vehicle usage data based on at least one usage characteristic of the vehicle, the on-board diagnostics module further comprising a transceiver operative to transmit the vehicle usage data to a driving behaviour scoring server of the driver behaviour monitoring system via a controller, the controller and a server being arranged to be in real-time communication with the controller via a telecommunications network, the server comprising a database on which road usage data is stored, the server further comprising a data processor controlled by an algorithm such that the server is operative to generate an alert signal from processing the vehicle usage data generated by the on-board diagnostics module and from the vehicle usage data stored on the database, the alert signal being indicative of a driving behaviour score.

According to a third aspect of the invention there is provided a method of monitoring driving behaviour comprising steps of:

using an on-board diagnostics module adapted to be mounted in a vehicle to monitor usage of the vehicle;

generating vehicle usage data based on at least one usage characteristic of the vehicle, transmitting the vehicle usage data to a driving behaviour scoring server in real-time communication via a telecommunications network;

providing a database on which road usage data is stored;

controlling the server by an algorithm such that the server is operative generate an alert signal from processing the vehicle usage data generated by the on-board diagnostics module and from the vehicle usage data stored on the database, the alert signal being indicative of a driving behaviour score.

Other aspects of the present invention may include any combination of the features or limitations referred to herein.

Figure 2:
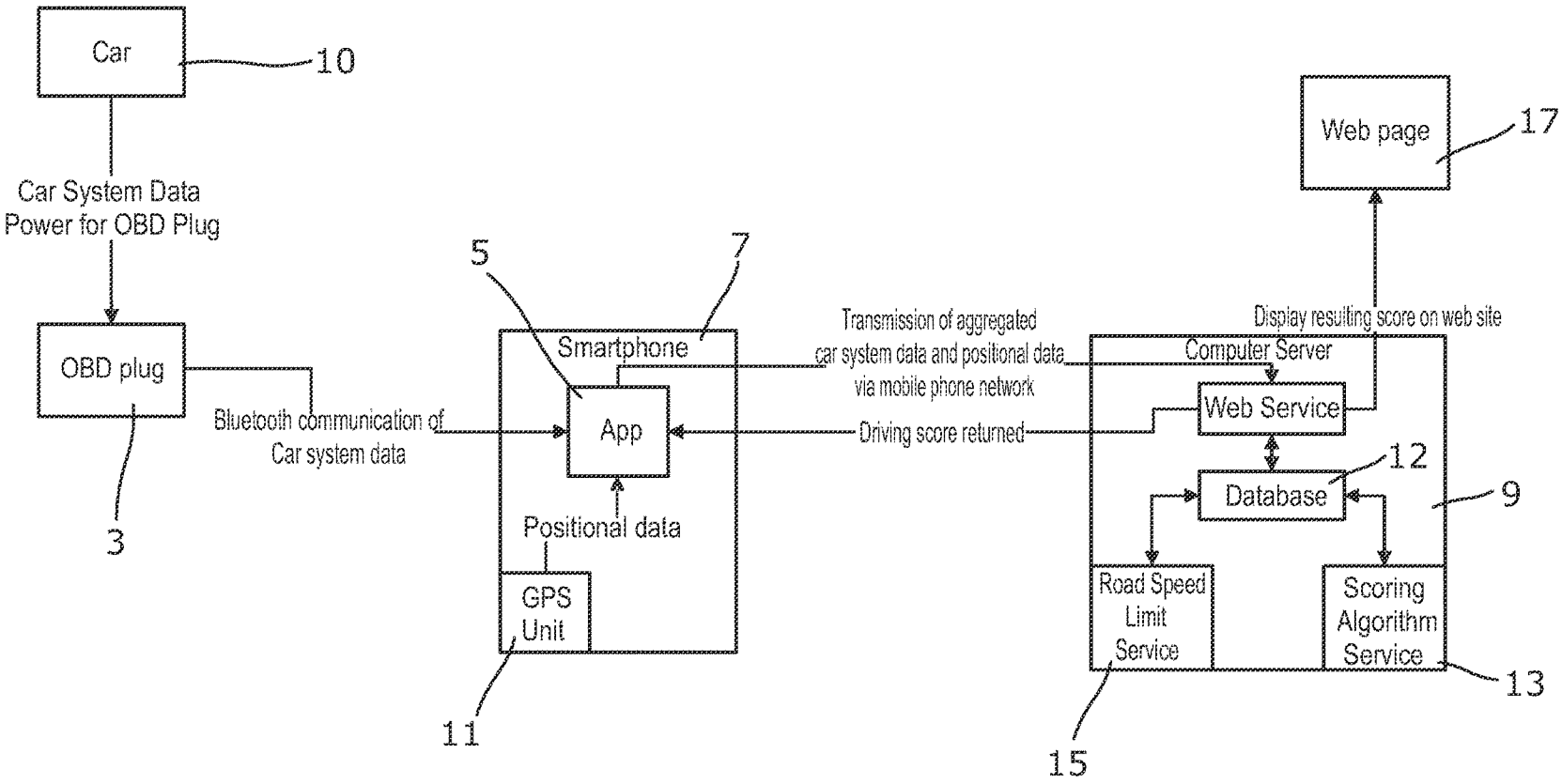

The present invention may be carried into practice in various ways, but embodiments will now be described by way of example only with reference to the accompanying drawings in which:

FIG. 1 is a schematic view of a driving behaviour monitoring system in accordance with the present invention; and FIG. 2 is a control diagram of the system of FIG. 1.

A driving behaviour monitoring system 1 comprises an on-board diagnostics module 3, a controller 5, which in this example is in the form of a software application downloaded onto a mobile telecommunications device 7, and a server 9. The module 3 is provided with a wireless data transceiver such as a Bluetooth® unit which wirelessly transmits vehicle usage data to the controller 5. The controller 5 transmits the vehicle usage data, optionally along with vehicle positional data obtained from a GPS unit 11 on the device 7 to the server 9 via a standard mobile telecommunications network as encrypted data. On-board diagnostics module 3 is adapted to be mounted on a vehicle 10 such that the on-board diagnostics module 3 cannot move relative to the vehicle 10, that is, so that the movement and forces of the vehicle 10 equal those of the on-board diagnostics module 3. The vehicle 10 may be provided with a suitable socket into which the on-board diagnostics module 3 can be inserted and retained.

The server 9 is operated remotely and comprises a database 12 on which vehicle usage data is stored, and from which a driving behaviour score is calculated, stored, and transmitted back to the controller and/or optionally to a linked website. The driving behaviour score is calculated by a software algorithm 13 on the server from the vehicle usage data generated by the on-board diagnostics module 3, the vehicle positional data if any, the vehicle usage data stored on the database 12, and optionally also from road speed limit data obtained from a road speed limit service 15.

The algorithm 13 is operative to generate an alert signal a score which rates the driving behaviour of the driver of the vehicle 10, in real-time, on a predetermined scoring system stored on the database 12. That algorithm 13 may reference other vehicle usage data prestored on the database 12 such as earlier scores of the driver in question, earlier scores for the vehicle in question, and any other desired data such as relating to manufacturer's stated vehicle performance, and the age of the vehicle for example. The score may be generated so as to provide the driver with an indicator of a driving or vehicle characteristic. That characteristic might be how safely the driver is driving, or how fuel economically the driver is driving.

The signal indicative of the driving behaviour score is transmitted from the server 9 to the controller 5 in real-time, via the mobile telecommunications network. The controller 5 may be operative to store the score for later review or may be operative to instantaneously display the score on the display of the mobile device 7, or an associated display of the onboard diagnostics module 3. The score may also be transmitted from the server 9 to a remote webpage 17 for later review either by the vehicle driver, or an external agency such as an insurance provider.

Preferably the controller 5 comprises a Smartphone software application downloaded onto the Smartphone 7, and the on-board diagnostics module 3 comprises a Bluetooth® slave device that wirelessly transmits data to the controller 5, that is, to the Smartphone 7.

The Smartphone application 5 is downloaded onto the driver's Smartphone 7. It is securely paired to the Bluetooth transceiver of on-board diagnostics module 3 using a unique code. The on-board diagnostics module 3 may also comprise an interface that enables the on-board diagnostics module 3 to receive data from the vehicle's European On Board Diagnostic's (EOBD) port.

Once the Smartphone 7 detects the Bluetooth on-board diagnostics module 3, the Smartphone application 5 may automatically start to record data, or may prompt the vehicle driver to allow the module 3 to begin recording data. The data recorded can include one, some or all of the following vehicle usage characteristics as time stamped events, time stamped at a periodic frequency as required:

a) Latitude
b) Longitude
c) Heading direction
d) Velocity
e) Attitude
f) Horizontal GPS accuracy
g) Vertical GPS accuracy The on-board diagnostics module 3 comprises a Bluetooth® transceiver unit, a micro-processor, a printed circuit board, a flash-memory and may also comprise an EOBD interface, tri-axial accelerometer and/or an internal battery. The on-board diagnostics module 3 is operative to send periodic packets of time stamped vehicle usage data to the controller 5 indicative of one, some or all of the following vehicle usage characteristics:

Vehicle ignition-on and ignition-off events

Bluetooth® device connection and disconnection events to/from EOBD port

Bluetooth® power on and off events

Accelerometer data in three axes: x, y and z.

Other such data available from the appropriate vehicle management system

The controller 5 receives data wirelessly from the on-board diagnostics module 3 and aggregates this data to any vehicle positional data as may be recorded via the GPS unit 11 on the Smartphone. The Smartphone 7 transmits all (aggregated) vehicle usage data to the database 12 via machine-to-machine communication at a parameterised data recording frequency, using the mobile telecommunications network. The database 12 then generates a signal indicative of a driving behaviour score calculated inside the server 9 in real-time. The driving behaviour score may or may not be displayed via the Smartphone 7 to the driver, also in real-time.

By real-time, we mean as close as is possible to instantaneous, allowing for latency in data transmission time from the on-board diagnostics module 3 to the controller 5, from the controller 5 to the server 9, and vice versa, and also allowing for any processing time taken by the algorithm in the server 9. It is intended that the driver behaviour score be transmitted sufficiently quickly that the driver can modify his behaviour at that time, rather than waiting until after he has finished driving.

In relation to initiation of the communication link between the controller and the transceiver, this is achieved by way of the transceiver detecting when the controller is in range. This could be achieved by way of the transceiver issuing polling signals to determine whether the controller is in the vehicle. By arranging that the transceiver initiates the communication link, this ensures more efficient use of battery resource available for the controller. Otherwise, the controller would issue polling signals unnecessarily when it was not in the vehicle. In this manner, the transceiver serves as the master and the controller as the slave. Moreover, in the event that the controller is detected by the transceiver to be in range of the controller, but is not in the vehicle, the transceiver can look at other data, such as the RPM of the vehicle, and can determine whether data should be transmitted to the controller. If it is determined that the RPM is zero, the transceiver can determine that the vehicle is stationary and so no data needs to be transmitted to the controller.

The use of the slave on-board diagnostics module 3 removes the need for the Smartphone 9 to be affixed immovably to the vehicle, and thus alleviates any inaccuracy in accelerometer readings that might otherwise occur from the Smartphone 9 moving in use. The on-board diagnostics module 3 is adapted to be permanently or removably fixed to the vehicle, using any suitable form of bracket, fixing or plug-socket arrangement. The module may be embodied as a "bolt-on" or retro-fit component.

In an alternative embodiment, the onboard diagnostics module 3 is provided with the controller 5, the transceiver being a mobile telecommunication device transceiver operative to communicate with the mobile telecommunications network, and therefore the server 9, directly, without a mobile telephone 7 as an intermediary. In this instance the onboard diagnostics module 3 may comprise its own SIM and SIM card, and any other component of a mobile telephone as may be required.

I claim:

1. A system comprising:

an on-board diagnostics module adapted to be mounted in a vehicle, the on-board diagnostics module comprising: an accelerometer; and a vehicle usage monitor operative to monitor usage of the vehicle and to generate vehicle usage data based on at least one usage characteristic of the vehicle;

a controller configured for communication with a driving behavior scoring server, the driving behavior scoring server arranged to be in real-time communication with the controller via a telecommunications network;

the on-board diagnostics module further comprising:

a transceiver comprising a retrofittable on-board-diagnostic (OBD) port device, the transceiver operative to:

selectively determine vehicle usage data for transmission to the controller, wherein the vehicle usage date includes accelerometer data; and transmit the selectively determined vehicle usage data to the driving behavior scoring server via the controller;

wherein the driving behavior scoring server comprises a database on which vehicle usage data is stored, the driving behavior scoring server further comprising a data processor operative to generate an alert signal by processing the vehicle usage data generated by the on-board diagnostics module and road usage data stored on the database, the alert signal being indicative of a driving behavior score, and wherein the server is operative to transmit the alert signal from the server to the controller.

2. The system of claim 1; wherein the driving behavior scoring server and the controller are arranged such that the alert signal is transmitted to the controller such that the driving score is displayed in real-time.

3. The system of claim 1, wherein the on-board diagnostics module comprises a wireless transceiver operative to transmit and/or receive data from the controller wirelessly, the controller being provided on a separate mobile telecommunications device.

4. The system of claim 1, wherein the on-board diagnostics module and controller are integral, the transceiver of the on-board diagnostics module comprising a mobile telecommunications transceiver operative to enable communication between the controller and the driving behavior scoring server via a mobile telecommunications network.

5. The system of claim 1, wherein the on-board diagnostics module further comprises a micro processor, a PCB, a flash memory, and a tri-axial accelerometer.

6. The system of claim 1, wherein the on-board diagnostics module is powered by an internal battery, or comprises a suitable electrical connection to receive power from the vehicle.

7. The system of claim 1, wherein the on-board diagnostics module further comprises an interface operative to connect with, and receive data from, the vehicle's On Board Diagnostics port.

8. The system of claim 1, wherein the on-board diagnostics module is configured to process a time signal and to obtain vehicle usage data at periodic time intervals, the on-board diagnostics module further configured to time stamp the vehicle usage data based on the processed time signal, and to send time stamped data packets of vehicle usage data to the controller.

9. The system of claim 1, wherein the on-board diagnostics module comprises a clock operative to generate a time signal, or receives a time signal generated from a clock on the controller or the driving behavior scoring server.

10. The system of claim 1, wherein the on-board diagnostics module is operative to obtain vehicle usage data selected from one or more of the following vehicle usage characteristics:

wireless device connection and disconnection events to/from an on-board-diagnostics port; and wireless power on and off events.

11. The system of claim 1, wherein the controller comprises a software application downloaded to one or more of a mobile telecommunications device and the onboard diagnostics module.

12. The system of claim 1, wherein the controller is configured to receive positional information from a GPS unit, the controller is further configured to combine the positional information with the vehicle usage information from the on-board diagnostics module to form an aggregated vehicle usage data for transmission to the driving behavior scoring server.

13. The system of claim 12, wherein the GPS unit comprises a GPS unit on the mobile telecommunications device, or comprises a GPS unit provided on the onboard diagnostics module.

14. The system of claim 1, wherein the driving behavior scoring server is configured to store road usage data indicative of a road speed limit, wherein the vehicle usage data and the road usage data are processed to generate the driving behavior score.

15. An on-board vehicle usage diagnostics module comprising an accelerometer, and adapted to be mounted in a vehicle, and a vehicle usage monitor operative to monitor usage of the vehicle and to generate vehicle usage data based on at least one usage characteristic of the vehicle, the on-board diagnostics module further comprising a retrofittable on-board-diagnostic (OBD) port-transceiver operative to:

selectively determine vehicle usage data for transmission to the controller, wherein the vehicle usage date includes accelerometer data; and transmit the selectively determined vehicle usage data to a driving behavior scoring server via a controller, the controller and driving behavior scoring server being arranged to be in real-time communication with the controller via a telecommunications network, the driving behavior scoring server comprising a database on which road usage data is stored, the driving behavior scoring server further comprising a data processor operative to generate an alert signal from processing the vehicle usage data generated by the on-board diagnostics module and from the vehicle usage data stored on the database, the alert signal being indicative of a driving behavior score, wherein the driving behavior scoring server is operative to transmit the alert signal from the driving behavior scoring server to the controller for review by a driver.

16. A method of monitoring driving behavior comprising steps of:

receiving, by a retrofittable transceiver in communication with an on-board-diagnostic (OBD) port, accelerometer data using an on-board diagnostics module, the on-board diagnostics module adapted to be mounted in a vehicle to monitor usage of the vehicle;

generating vehicle usage data based on at least one usage characteristic of the vehicle;

selectively determining, for transmission, vehicle usage data including accelerometer data;

transmitting the selectively determined vehicle usage data to a driving behavior scoring server in real-time communication via a telecommunications network;

providing a database on which road usage data is stored; and generating an alert signal from processing the vehicle usage data generated by the on-board diagnostics module and from the vehicle usage data stored on the database, the alert signal being indicative of a driving behavior score, wherein the method further comprises transmitting the alert signal from the driving behavior scoring server for review by a driver.

17. The method of claim 16, further comprising:

issuing, by the transceiver, polling signals to the controller; and determining whether the controller is in the vehicle.

18. The system of claim 1, wherein the transceiver is further operative to issue polling signals to determine whether the controller is in the vehicle.

19. The on-board vehicle usage diagnostics module of claim 15, wherein the transceiver if further operative to issue polling signals to determine whether the controller is in the vehicle.

* * * * *